US005125429A

United States Patent [19]

Ackroyd et al.

[11] Patent Number: 5,125,429

[45] Date of Patent: Jun. 30, 1992

[54] PISTON PRESSURE-TYPE VACUUM BREAKER

[75] Inventors: Rand H. Ackroyd, Methuen; Steven P. Hofmann, Tewksbury, both of Mass.

[73] Assignee: Watts Regulator Company, Lawrence, Mass.

[21] Appl. No.: 643,750

[22] Filed: Jan. 23, 1991

[51] Int. Cl.[5] ..... E03C 1/10

[52] U.S. Cl. ..... 137/218; 137/512.2

[58] Field of Search ..... 137/218, 512.2

[56] References Cited

U.S. PATENT DOCUMENTS

| | | | |
|---|---|---|---|
| 2,209,189 | 7/1940 | Callejo | 137/218 |
| 2,627,278 | 2/1953 | Somers | 137/218 |
| 2,655,171 | 10/1953 | Cantor | 137/218 |
| 2,960,996 | 11/1960 | Haselton | 137/218 X |
| 3,083,723 | 4/1963 | Duchin | 137/218 |
| 3,180,352 | 4/1965 | Kersten et al. | 137/218 |
| 3,189,037 | 6/1965 | Callejo | 137/218 |
| 3,286,722 | 11/1966 | Royer | 137/218 |
| 3,918,477 | 11/1975 | Grams | 137/218 |
| 4,013,088 | 3/1977 | Gocke et al. | 137/218 X |
| 4,508,137 | 4/1985 | Bolgert | 137/218 |
| 4,592,382 | 6/1986 | Rubin et al. | 137/218 |

FOREIGN PATENT DOCUMENTS 2157363 5/1973 Fed. Rep. of Germany ..... 137/218

OTHER PUBLICATIONS

"*Series 800 Anti-Siphon Pressure Type Vacuum Breakers*", Watts Regulator Comany, PS-800-6, ES-800-6 898 IS-800-4, IS-800-4 881 (undated).

*Primary Examiner*—Gerald A. Michalsky

*Attorney, Agent, or Firm*—Fish & Richardson

[57] ABSTRACT

A pressure-type vacuum breaker for use in a fluid flow line has a housing defining a central bore and an inlet, an outlet and a discharge vent. A piston assembly disposed within the central bore is movable within the bore between first and second positions. In the first position of the piston assembly, the inlet is closed, the discharge vent is open and the outlet is in communication with the discharge vent and the atmosphere. In the second position of the piston assembly, the discharge vent is closed, the inlet is open and the outlet is in communication with the inlet, thereby to permit liquid flow between inlet and outlet. The position of the piston assembly is in predetermined response to pressure of liquid at the inlet.

6 Claims, 3 Drawing Sheets

PISTON PRESSURE-TYPE VACUUM BREAKER

BACKGROUND OF THE INVENTION

Figure 1:
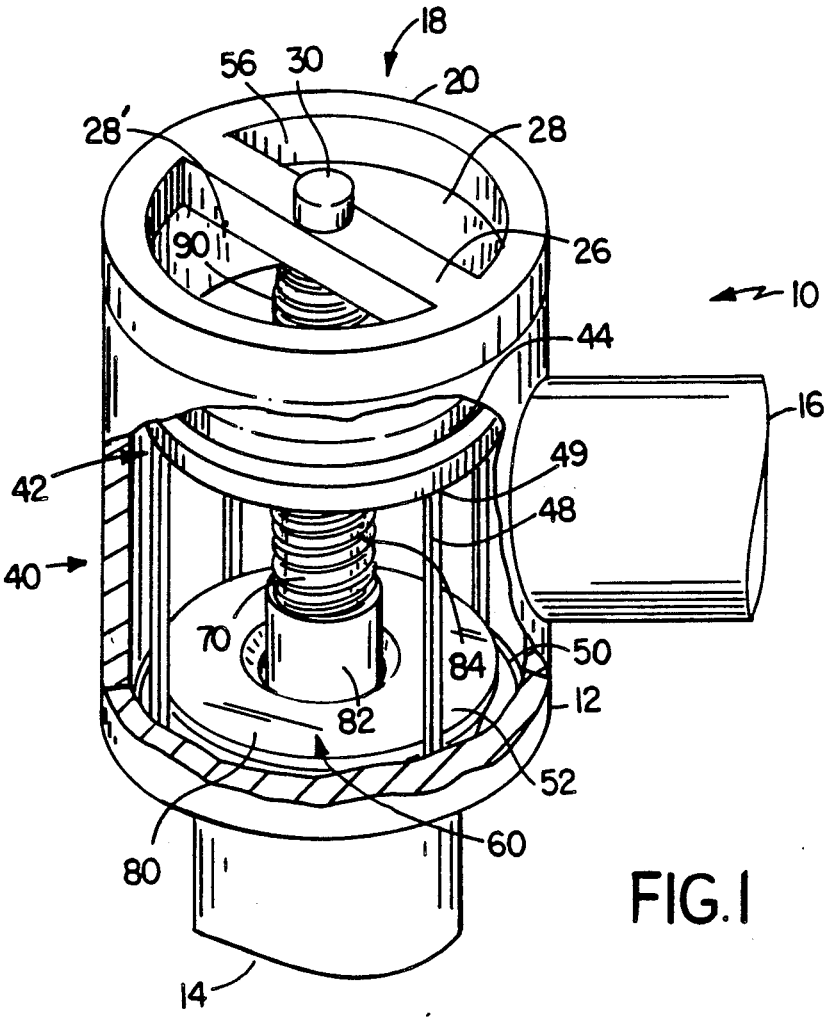

The invention relates to the field of pressure-type vacuum breaker valves.

In a system of fluid piping, in the event of a reduction or reversal of supply pressure, a pressure-type vacuum breaker valve is designed to prevent the backwards siphoning of water or other liquid from an outlet towards the inlet or supply source by "breaking" or relieving the vacuum caused by the pressure decrease. In a vacuum breaker, a valve controls the flow of liquid from a vent, so as to discharge liquid in the outlet line if liquid pressure in the outlet line exceeds atmospheric pressure. Typically such pressure-type vacuum breakers are used to provide protection between a contaminant source and a water supply.

In one prior art pressure-type vacuum breaker, two separate valves are mounted on two separate spring assemblies. A first valve adjacent the inlet is biased closed by a first spring assembly, while the second valve adjacent the discharge outlet is biased open by the second spring assembly. Due to the independent nature of the spring assemblies, the two valves in the prior art vacuum breaker do not work in tandem, thereby permitting liquid to discharge through the vent during initial pressurization, i.e. between the time when the system pressure is sufficient to open the valve at the inlet and when the pressure in the system is sufficiently to cause the valve at the discharge vent to close.

SUMMARY OF THE INVENTION

According to the invention, a pressure-type vacuum breaker for use in a fluid flow line comprises a housing defining a central bore and having an inlet, an outlet and a discharge vent; and a piston assembly disposed within the central bore, the piston assembly movable within the bore between a first position and a second position. In the first position of the piston assembly, the inlet is closed, the discharge vent is open and the outlet is in communication with the discharge vent and the atmosphere. In the second position of the piston assembly, the discharge vent is closed, the inlet is open and the outlet is in communication with the inlet, thereby to permit liquid flow between the inlet and the outlet. The position of the piston assembly is in predetermined response to pressure of liquid at the inlet.

Preferred embodiments of the invention may include one or more of the following features. The housing has a first end and a second end, the inlet being located at the first end, the discharge vent being located at the second end, and the outlet being located between the first end and the second end. The piston assembly comprises an outer piston assembly slidably mounted within the bore and an inner piston assembly slidably mounted within the outer piston assembly. The outer piston assembly comprises a vent valve adapted to close the discharge vent when the outer piston assembly is in the second position. Preferably, the discharge vent comprises a bonnet having a vent opening and a piston spring, the piston spring being positioned between the bonnet and the vent valve and adapted to bias the outer piston assembly toward the first position. More preferably, the inner piston assembly comprises a check valve movable between a first position in which liquid is prevented from flowing into the bore when the outer piston assembly is in the first position and a second position in which liquid is permitted to pass from the inlet to the outlet when the outer piston assembly is in the second position. The inner piston assembly further comprises an inner piston spring disposed between the check valve and the vent valve and adapted to bias the check valve toward the first position. The piston spring has a smaller compression constant than the inner piston spring, and the inner piston spring is adapted to compress only when the pressure exerted at the inlet is sufficient to cause the piston spring to compress and permit the piston assembly to close the discharge vent.

Thus the vacuum breaker of the present invention provides two valves which work in tandem to prevent discharge of fluid during initial pressurization.

These and other features and advantages of the invention will be seen from the following description of a presently preferred embodiment, and from the claims.

DESCRIPTION OF A PRESENTLY PREFERRED EMBODIMENT

We first briefly describe the drawings.

Figure 1A:
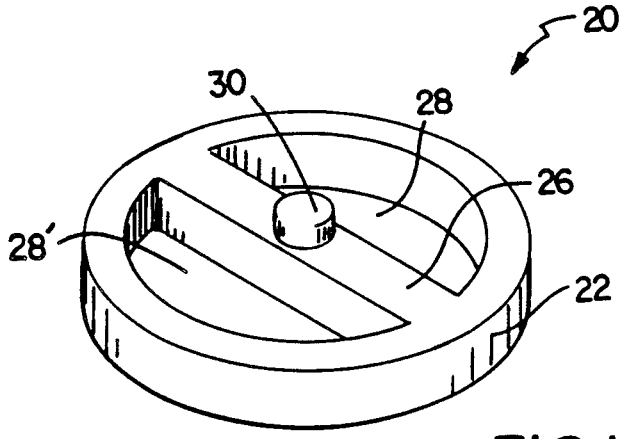
Figure 2:
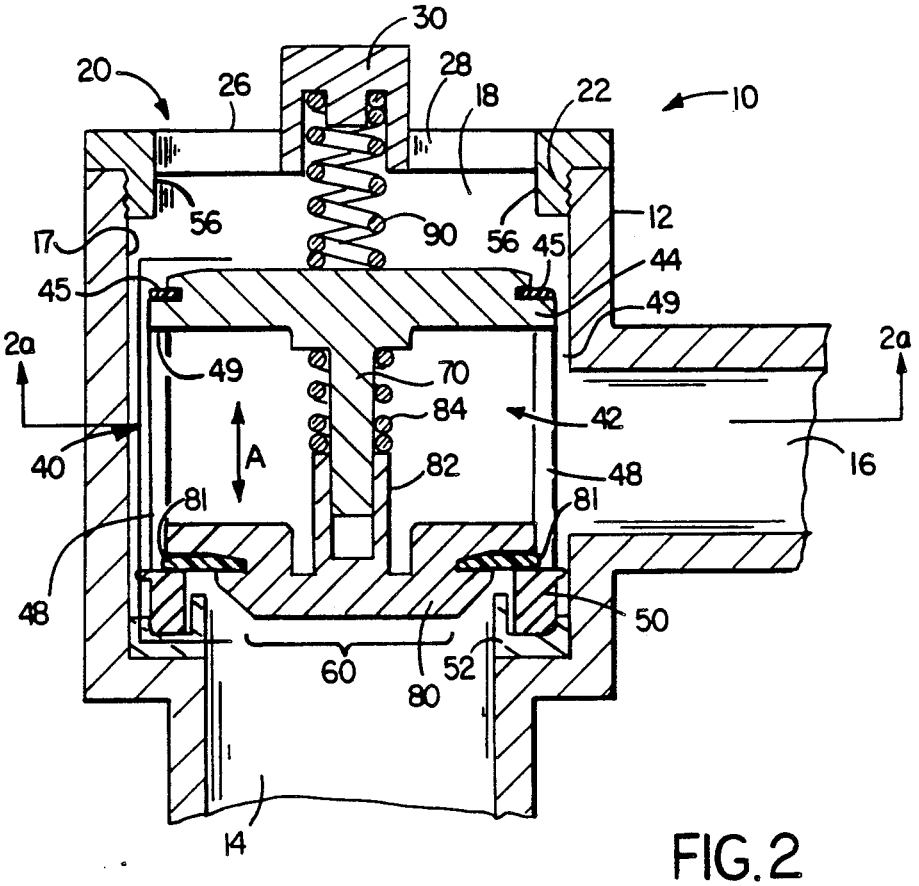
Figure 2A:
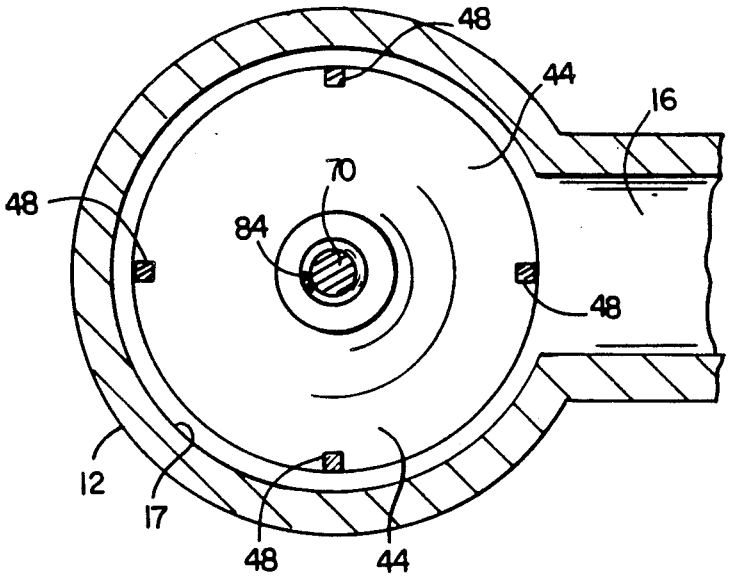
Figure 3A:
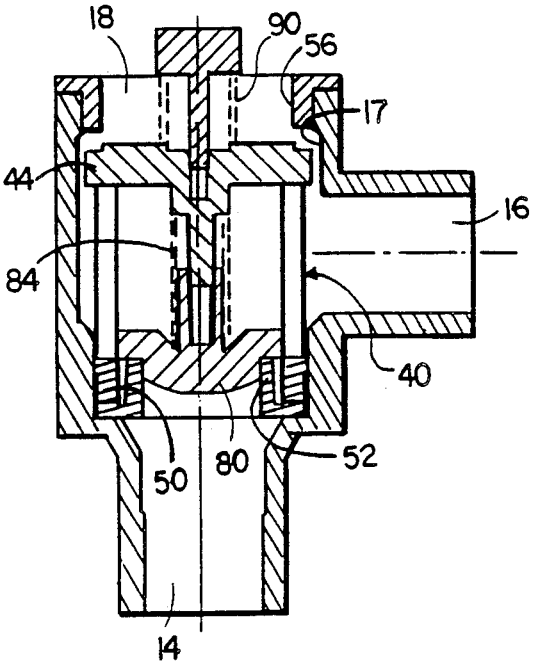
Figure 3B:
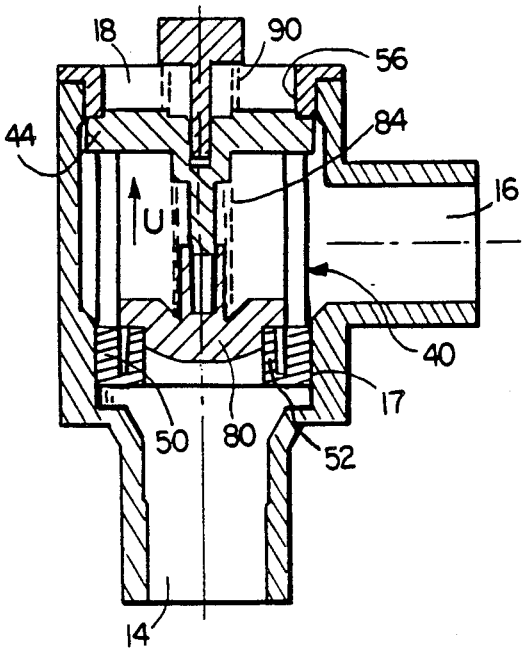
Figure 3C:
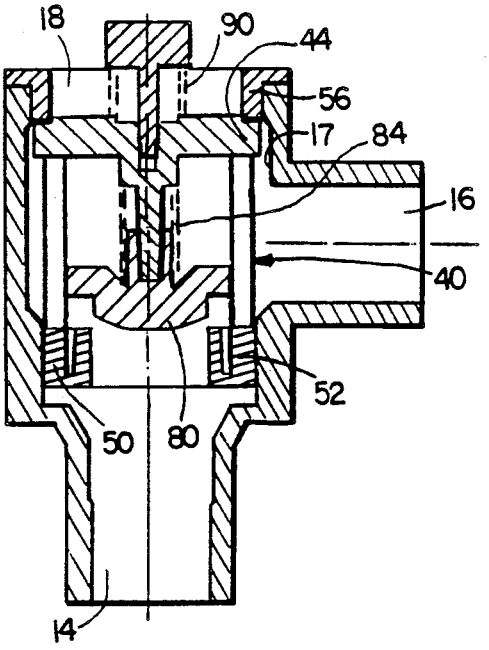
Figure 3D:
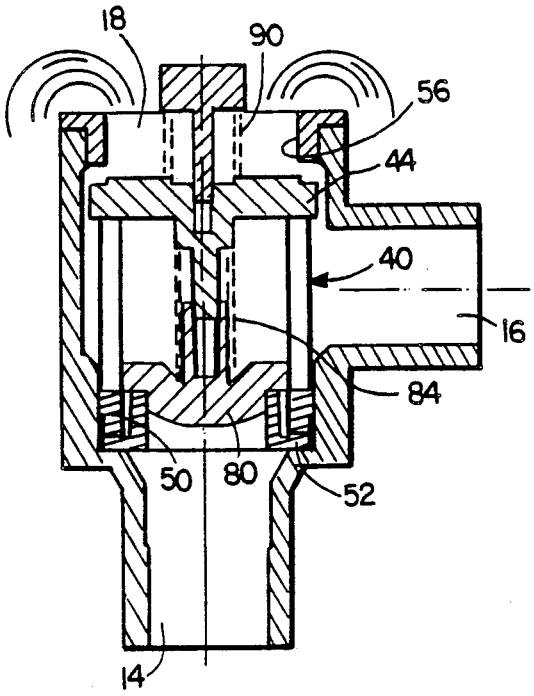

FIG. 1 is an isometric view, partially in section, of a pressure-type vacuum breaker of the invention;

FIG. 1*a* is a similar view of the bonnet of the vacuum breaker of FIG. 1;

FIG. 2 is a side section view of the vacuum breaker of the invention taken at the line 2—2 of FIG. 1;

FIG. 2*a* is a top section view of the vacuum breaker taken at the line 2*a*–2*a* in FIG. 2; and FIGS. 3*a*, 3*b*, 3*c* and 3*d* are sequential side section views of a vacuum breaker of the invention in unpressurized state (FIG. 3*a*), during initial pressurization (FIG. 3*b*), in pressurized condition permitting flow (FIG. 3*c*) and in a depressurized condition permitting venting (FIG. 3*d*).

Referring to the figures, a piston pressure-type vacuum breaker 10 of the invention has a housing 12 which defines an inlet 14, an outlet 16 and a vent opening 18. The housing 12 further defines a central bore 17 within which is disposed a piston assembly 40. The vent opening 18 is partially obstructed by a bonnet 20 (FIG. 1*a*).

The bonnet 20 has a threaded annular portion 22 which engages corresponding threads in the wall of the central bore 17 of housing 12 adjacent the vent opening 18. The threads 22 permit the bonnet 20 to be removed, e.g. for maintenance of piston assembly 40, and then replaced. A strut 26 extends fixedly across diameter of the bonnet 20 and defines two openings 28, 28' which permit air to pass through the bonnet 20 into the central bore 17 and which permit liquid to pass from the bore 17 out through the bonnet 20. At the center of the strut 26 is a piston spring retaining neck 30, about which more will be said shortly.

The piston assembly 40 is located within the housing 12, and retained there by the bonnet 20. The piston assembly consists of an outer piston assembly 42 and an inner piston assembly 60. The outer piston assembly 42 includes an upper vent valve 44, piston supports 48, an annular seal gasket retainer 50 and an annular valve gasket 52. The ends 49 of several piston supports 48 are attached adjacent to the edge of the upper vent valve 44 and extend perpendicularly from the surface of the upper vent valve 44, which faces into the central bore 17. An inner piston guide 70 extends from the surface of the upper vent valve 44, which faces the inner piston assembly 60. The annular gasket retainer 50 is attached to the other end of the piston supports 48, and the annular valve gasket 52 is removably attached to the valve gasket retainer 50. Together, the upper vent valve 44, piston supports 48, annular gasket retainer 50 and annular valve gasket 52 define a piston assembly of generally cylindrical shape, with an axis concentric with the central bore 17 of the housing 12. The piston assembly 40 is shorter in length than length of the central bore 17 of the housing 12 and so may move within the housing 12 in an axial direction (arrow A).

When the piston assembly 40 is in its lowest position, adjacent to inlet 14, the annular valve gasket 52 bears against the wall of the central bore 17 of the housing 12 adjacent the inlet 14 to prevent water from passing through the inlet and between the piston assembly 40 and the wall of the central bore. When the piston assembly 40 is in its highest position, adjacent the bonnet 20, the upper vent valve 44 abuts the bonnet valve seat 56, with o-ring seal 45 (FIG. 2) disposed therebetween to provide a seal to prevent water from passing through the vent 18, either from the inlet 14 or the outlet 16.

The inner piston assembly 60 consists of a check valve 80 and an inner piston compression spring 84. Assembly 60 is disposed concentric with the outer piston assembly 40 and moves along the axis of the outer piston assembly 40 (arrow A). In its lowest position, adjacent the valve gasket retainer 50, the inner check valve 80 abuts the valve gasket retainer 50 with o-ring seal 81 disposed therebetween to provide a seal and prevent water from flowing between the valve gasket retainer 50 and the inner check valve 80. The combination of inner check valve 80, valve gasket retainer 50 and annular valve gasket 52 prevents water from flowing from the inlet 14 into the central bore 17 when the inner check valve 80 is adjacent to the valve gasket retainer 50. An annular cylinder 82 extends from the surface of the inner check valve 80, which faces the upper vent valve 44, and is slidably mounted upon the inner check valve guide 70. The inner piston compression spring 84 is positioned concentric with the inner check valve guide 70 and serves to bias the inner check valve 80 toward the valve gasket retainer 50.

A piston spring 90 is retained within the piston spring retaining neck 30, between the bonnet 20 and the upper vent valve 44. The piston spring is a compression spring having a compression constant less than the inner piston compression spring 84, and serves to bias the piston assembly 40 toward the inlet 14.

The operation of a pressure-type vacuum breaker of the invention will now be described with reference to FIGS. 3*a*–3*d*.

Referring first to FIG. 3*a*, under a condition of no pressure at the inlet 14, the piston spring 90 biases the piston assembly 40 to the lowest position in the central bore 17, adjacent the inlet 14. The inner piston compression spring 84 biases the inner check valve 80 against the valve gasket retainer 50. The position of the piston assembly 40 and the inner check valve 80 results in the inlet 14 being closed and the vent 18 open, with the outlet 16 at atmospheric pressure.

As the pressure at the inlet 14 rises (FIG. 3*b*), the piston spring 90 compresses, thereby permitting the piston assembly 40 to move toward the vent 18 (arrow U). The compression constant for the piston spring 90 is less than the compression constant for the compression spring 84, so the compression spring 84 does not compress, but instead keeps the check valve 80 biased against the valve gasket retainer 50. Therefore, as the piston assembly 40 moves toward the vent 18, the seal between the annular valve gasket 52/valve gasket retainer 50 and the wall of the bore 17 (e.g., an o-ring seal or a rolling diaphragm-type seal, not shown), and the o-ring seal 81 between the check valve 80 and the valve gasket retainer 50 prevent water from the inlet 14 from flowing either to the outlet 16 or the vent 18.

When the pressure in the inlet 14 is high enough to compress the piston spring 90 fully, the upper vent valve 44 of the piston assembly 40 abuts against the bonnet valve seat 56 and closes the vent 18, thereby isolating the inlet 14, the outlet 16 and the vent 18 from one another. As the pressure in the inlet 14 increases further (FIG. 3*c*), the compression spring 84 begins to compress, allowing the check valve 80 to move away from the valve gasket retainer 52, permitting water to flow from the inlet 14 to the outlet 16, while still preventing flow through the vent 18.

In the event of a loss of pressure in the inlet 14, the force compressing both springs 84, 90 is removed. The inner piston compression spring 84 biases the inner check valve 80 back against the valve gasket retainer 50, which along with the annular valve gasket 52 prevents liquid from the outlet 16 from flowing back into the inlet 14. Simultaneously, the piston spring 90 biases the piston assembly 40 back toward the inlet 14, thereby moving the upper vent valve 44 away from the bonnet valve seat 56 and opening vent 18. If the pressure in the outlet 16 is higher than atmospheric pressure, liquid will discharge from the outlet 16 out the vent 18. Once the pressure in the outlet 16 has been reduced to atmospheric pressure, the venting of liquid ceases.

When the pressure at inlet 14 exceeds the pressure at the outlet 16 to a degree sufficient to cause piston spring 90 to compress, the vent 18 is closed and the pressurization steps shown in FIGS. 3*a*–3*c* are repeated.

Other embodiments are within the following claims.

What is claimed is:

1. A pressure-type vacuum breaker for use in a fluid flow line comprising a housing defining a central bore and having a first end and a second end, an inlet located in a region adjacent said first end, an outlet located between said first end and said second end and a discharge vent located in a region adjacent said second end, said outlet also located between said inlet and said discharge vent; and a piston assembly disposed within said central bore, said piston assembly adapted to move within said central bore between a first position and a second position, in said first position of said piston assembly, said inlet being closed, said discharge vent being open and said outlet being in communication with said discharge vent and the atmosphere, and in said second position of said piston assembly, said discharge vent being closed, said inlet being open and said outlet being in communication with said inlet, thereby to permit liquid flow between said inlet and said outlet, said piston assembly comprising an outer piston assembly and an inner piston assembly mounted within said outer piston assembly, said outer piston assembly comprising a vent valve adapted to close said discharge vent when said piston assembly is in said second position, the position of said piston assembly being in predetermined response to pressure of liquid at said inlet.

2. The vacuum breaker of claim 1 wherein said discharge vent comprises a bonnet having a vent opening and a piston spring, said piston spring being positioned between said bonnet and said vent valve and adapted to bias said outer piston assembly toward said first position.

3. The vacuum breaker of claim 2 wherein said inner piston assembly comprises a check valve movable between a first position in which liquid is prevented from flowing into said bore when said outer piston assembly is in said first position and a second position in which liquid is permitted to pass from said inlet to said outlet when said outer piston assembly is in said second position.

4. The vacuum breaker of claim 3 wherein said inner piston assembly further comprises an inner piston spring disposed between said check valve and said vent valve and adapted to bias said check valve toward said first position.

5. The vacuum breaker of claim 4 wherein said piston spring has a smaller compression constant than said inner piston spring.

6. The vacuum breaker of claim 5 wherein said inner piston spring is adapted to compress only when the pressure exerted at said inlet is sufficient to cause said piston spring to compress and permit said piston assembly to close said discharge vent.

* * * * *